United States Patent [19]

McMullan et al.

[11] 4,340,983

[45] Jul. 27, 1982

[54] CRIB FLOTATION BED

[75] Inventors: James P. McMullan, 2630 Seaman Ave., El Monte, Calif. 91733; Rudy E. Lindsay, Garden Grove; Jerry E. Land, Huntington Beach, both of Calif.

[73] Assignee: James P. McMullan, Garden Grove, Calif.

[21] Appl. No.: 86,406

[22] Filed: Oct. 19, 1979

[51] Int. Cl.[3] ..... A47C 27/08; A47D 7/00; A47D 13/06

[52] U.S. Cl. ..... 5/93 R; 5/422; 5/451; 5/512

[58] Field of Search ..... 5/451, 452, 450, 422, 5/449, 93 R, 93 B, 512, 100

[56] References Cited

U.S. PATENT DOCUMENTS

| | | | |
|---|---|---|---|
| 3,707,735 | 1/1973 | Carson, Jr. | 5/451 |
| 3,777,673 | 12/1973 | Blazey et al. | 5/93 R |
| 4,120,062 | 10/1978 | Anderson | 5/453 |
| 4,186,457 | 2/1980 | Amelung | 5/452 |
| 4,190,916 | 3/1980 | McMullan | 5/451 |

*Primary Examiner*—Alexander Grosz

[57] ABSTRACT

A water bed crib comprising a water bed structure including a flat horizontal rectangular platform with an upwardly projecting weir about its perimeter, a water filled flexible mattress bladder supported atop the platform within the confines of the weir, platform legs at and depending from the four corner portions of the platform, floor engaging caster wheels at the lower end portions of the platform legs, crib frame leg supporting brackets projecting outwardly from the platform legs; a rectangular crib frame with vertical end boards and vertical side gates engaged about the water bed structure and having crib frame legs depending from its four corners and engaging the brackets on the platform legs; the crib frame legs have caster pintle receiving openings in their lower ends and the brackets have retaining pintles engaged in said openings.

12 Claims, 9 Drawing Figures

24
25
W
P
26
26
40
20
L
22
23
21
E
32
B
31
34
4
4
D

5
E
32
B
31
30
34
L
21
33
5

32
E
B
31
6
34
32'
21
D
33
30
L
6

31
B
32'
21
L
30
33

Fig. 2.
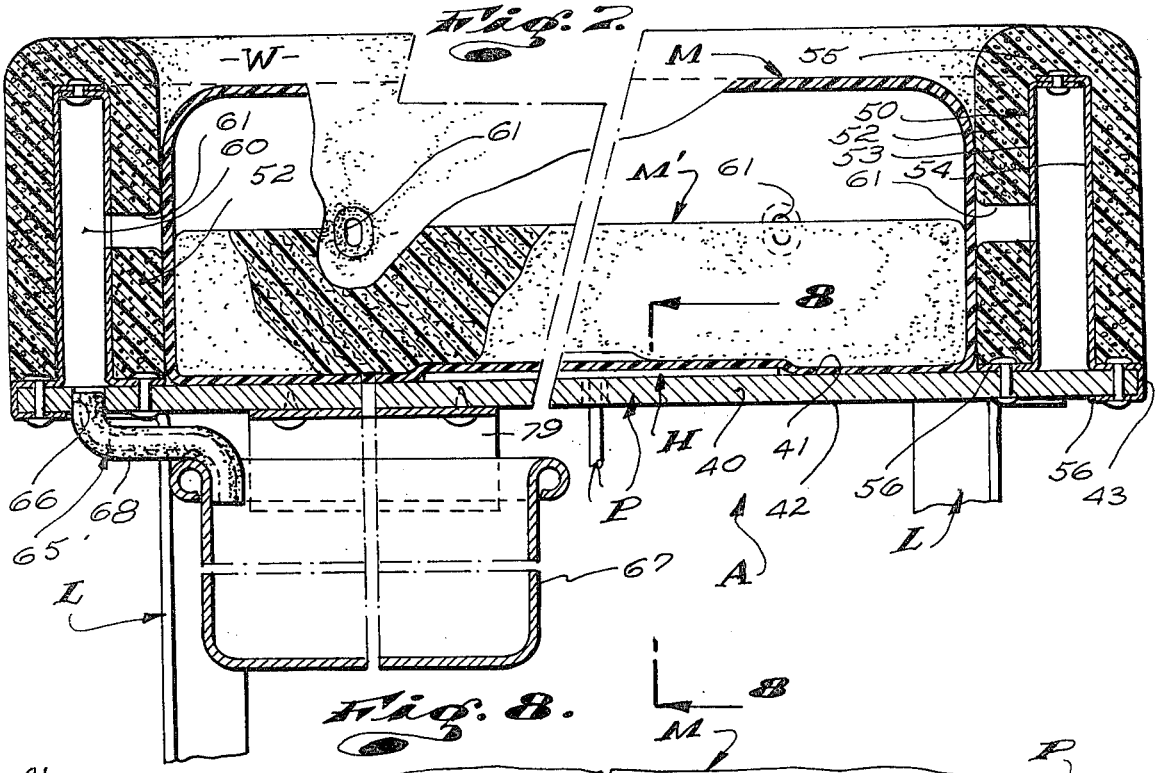
Fig. 8.
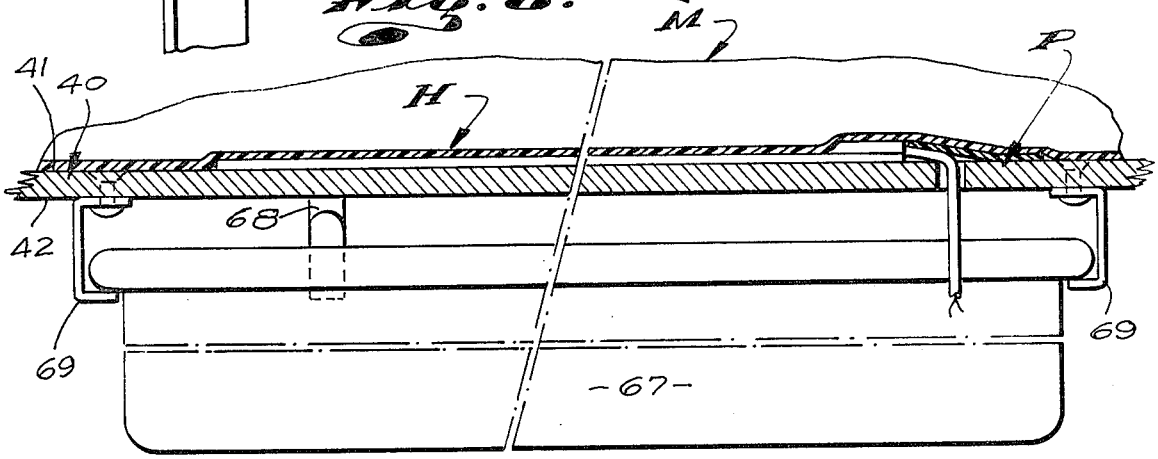
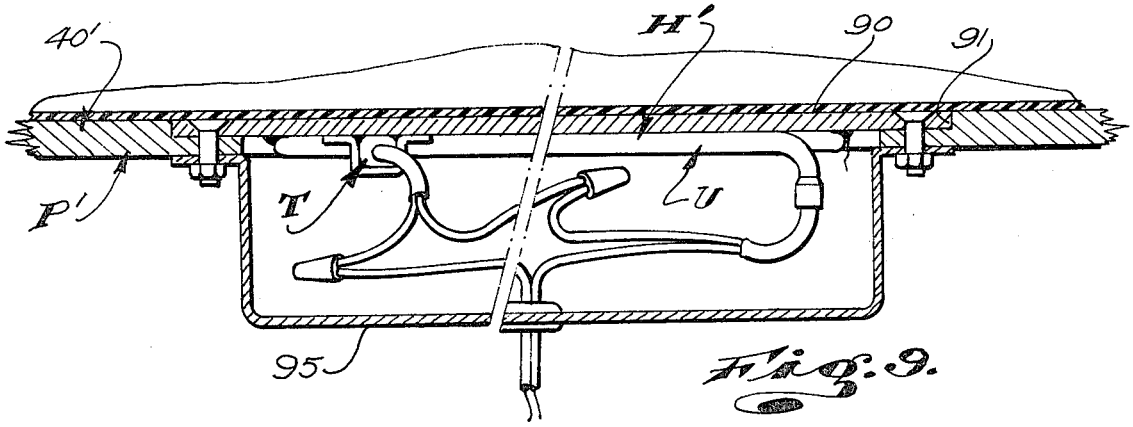
Fig. 9.

CRIB FLOTATION BED

This invention has to do with a crib for infants and small children and is particularly concerned with a novel crib structure with a flotation or water mattress.

BACKGROUND OF THE INVENTION

The present invention relates to that common form of crib which comprises a frame structure including like flat vertical end boards with floor engaging legs, elongate laterally spaced parallel side rails extending between the end boards, laterally spaced vertical side gates at the opposite sides of the frame between the end boards and shiftable vertically relative thereto, between up and down positions; and hanger means or brackets at the end board to releasably engage and support a spring frame and/or mattress structure within the crib frame.

The above noted type of crib frames, the spring frame and/or mattress structures therefor, and the bedding (sheets and blankets) for such crib structures, are produced by a multitude of different manufacturers and are, with rare exception, compatible and/or interchangeable one with respect to the other.

As a result of the above, while the crib frames of various manufacturers may differ in details of construction and in quality, they are, with rare exception, substantially standardized dimensionally so that they can effectively cooperatively receive and support standard spring frames and/or mattresses and so that standard crib sheets, blankets and the like can be used in conjunction therewith.

Special features or characteristics of standard crib frames which affect the present invention are that they are rectangular in plan configuration; they have unobstructed interiors and open vertically; they have four vertical floor engaging corner legs which extend vertically to define the vertical side edges of their related end boards; and they have hangers or brackets on their end boards to engage and support those standard spring frame and/or mattress structures used in combination therewith. The ordinary or standard crib frame is not a rigid structure independent of the spring frame and/or mattress structure with which it is related and depends greatly upon the rigidity and dimensional stability of the spring frame and/or mattress structure related to it to impart that degree of rigidity which is required to make it serviceable. That is, the spring frame and/or mattress structure in standard crib frames generally serve to reinforce and support or hold the frames in desired rectilinear configuration and prevent the frames from racking or collapsing, like articulated parallelogram structures.

In recent years, in the bedding art, notable advances have been made in flotation or water beds, which beds generally comprise water-filled, flexible bladder like mattresses upon which persons lie to rest and/or sleep and which substantially conform to and afford uniform support for the bodies of persons lying thereon.

In certain respects, the nature of body support afforded by water beds is materially different and notably superior to the nature of support afforded by all other types and/or forms of beds. As a result of the foregoing, while the use of water beds is oftentimes adopted for reasons of comfort alone, there are increasing instances where the provision and use of such beds is recommended or prescribed for therapeutic reasons.

While the bedding art has actively pursued the development of complete water bed structures and/or systems for adults, little or no attention has been given to the provision of such beds for infants and small children. This is believed and understood to be the result of the fact that commercially available bedding for infants and small children constitutes a small and specialized segment of the bedding market, coupled with the fact that the ordinary or conventional crib frame, which is a standard part of infant bedding, is structurally incapable or insufficient to effectively and safely engage and support water bed mattresses, which mattresses (due to the volumes of water contained thereby) are notably heavier than conventional mattress structures, which standard crib frames are intended and designed to receive and support.

As a result of the foregoing, it has been generally accepted in the bedding art that if water bed mattresses were to be provided for small children, special crib frame structures would have to be produced to accommodate and afford safe and adequate support for the heavier mattresses. Such special frames would have to be heavier, more durable and materially more costly than standard crib frames. Since crib frames have become standardized and are cheap to make and since the production of a more costly, non-standard or special crib frame structure for water bed mattresses would be a highly speculative undertaking by any manufacturer of crib frames, the manufacturers of crib frames have failed or sought to avoid the production and commercial exploitation of water bed cribs.

OBJECTS AND FEATURE OF THE INVENTION

An object of the present invention is to provide a novel water bed structure for use in combination with standard crib frames.

It is another object and feature of this invention to provide a water bed structure in combination with a standard crib frame and including crib frame leg engaging brackets to support the crib frame in cooperative working relationship with the water bed structure.

Still another object and feature of the present invention is to provide a water bed structure of the general character referred to above which includes a water bed mattress supporting and containing platform adapted to be cooperatively arranged within the confines of a standard crib frame, platform supporting legs to support the platform in predetermined vertical placement within the crib frame and crib frame supporting brackets on the platform legs upon which the legs of the crib frame are engaged, whereby the crib frame is supported and carried by the water bed structure and whereby the crib frame is not subjected to the weight of and is not required to support the water bed structure.

It is an object and feature of the present invention to provide a water bed structure of the general character referred to above wherein the platform legs are provided with floor engaging caster wheels to afford rolling movement of the construction across the supporting floor and wherein the crib frame supporting brackets are selectively movable relative to the platform legs whereby the brackets can be moved and set to cooperatively engage various or different makes and/or models of standard crib frames, the dimensional placement and/or size of the legs of which are not uniform or standardized.

In standardized crib frames, the lower ends of the crib legs are provided with vertical openings to cooperatively receive the vertical mounting pintles of standard furniture caster wheels.

It is an object of this invention to provide a combination water bed structure and crib frame of the character referred to above wherein said supporting brackets have crib frame retaining pintles engaged in the caster pintle receiving openings in the crib frame legs, whereby the crib frame is releasably retained against horizontal shifting and/or displacement relative to the water bed structure.

Yet another object and feature of the present invention is to provide a novel water bed structure including a flat horizontal water mattress supporting platform with an upwardly projecting weir about its perimeter to retain the mattress about its perimeter and/or the water within the mattress, said weir has an internal fluid conducting passage, fluid ports communicating with said passage and the inner mattress confining space defined by the platform, and structure to conduct water from said passage and to collect and hold that water, whereby water spilled or otherwise released from the mattress on the platform is effectively conducted away from the platform and collected.

It is an object and feature of the invention to provide a platform structure of the character referred to above wherein the weir includes a soft, resilient shock absorbing and heat insulating exterior surface or jacket whereby the platform is free of structure which might cause damage or injury to any person or object that might be moved into engagement with the weir during normal use of the construction.

Finally, it is an object and feature of the present invention to provide a water bed structure of the character referred to above having novel heating means to heat and maintain the bed structure at a desired predetermined temperature.

The foregoing and other objects and features of the invention will be fully understood from the following detailed description of typical preferred forms and applications of the invention throughout which description reference is made to the accompanying drawings.

DESCRIPTION OF THE DRAWINGS

FIG. 7 is a sectional view taken substantially as indicated by line 7—7 on FIG. 2;

FIG. 8 is a sectional view taken substantially as indicated by line 8—8 on FIG. 7; and FIG. 9 is a view similar to a portion of the structure illustrated in FIG. 7 of the drawings and showing another form of the invention.

DETAILED DESCRIPTION OF THE INVENTION

Figure 1:
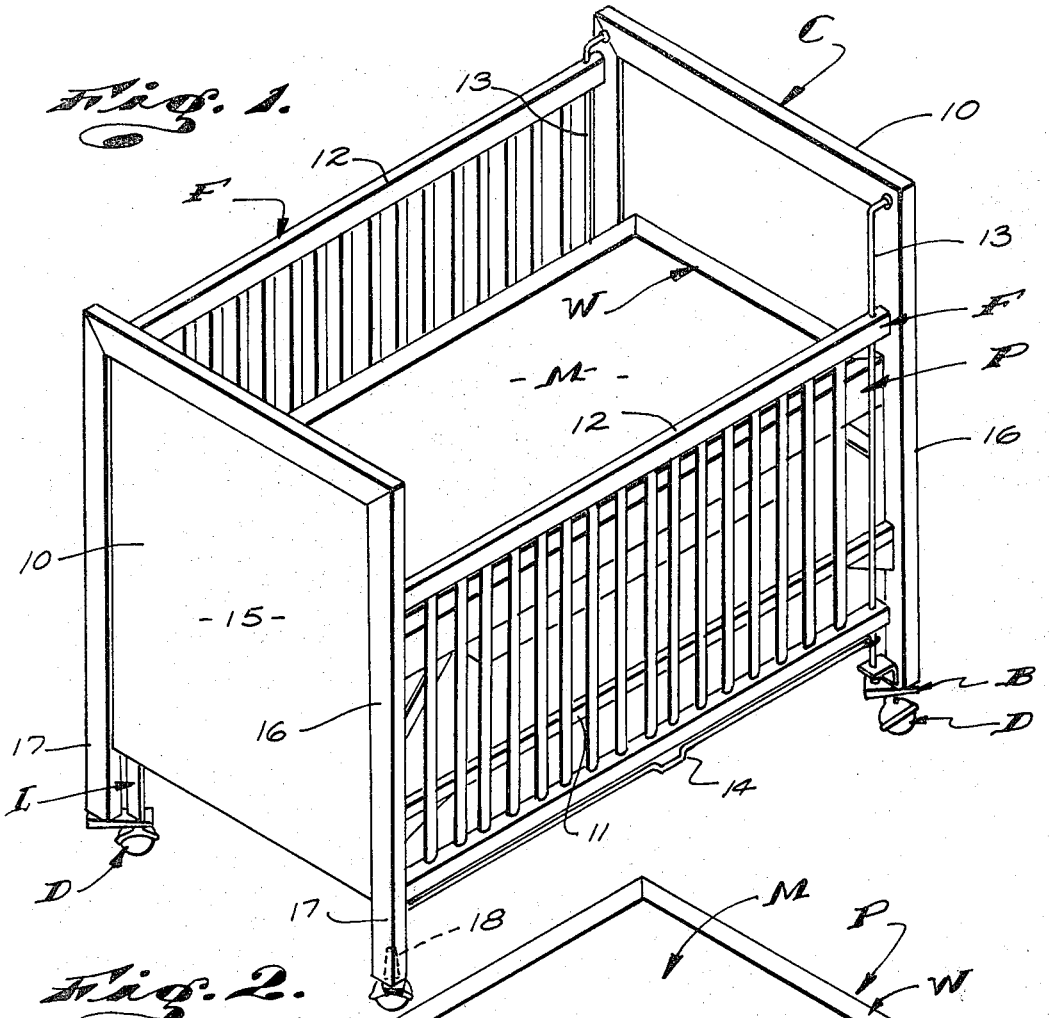
FIG. 1 is an isometric view of the new water bed structure in combination with a standard crib frame.

Referring to FIG. 1 of the drawings, a typical or standard crib frame C is shown related to the new crib water bed structure A.

The crib frame C is a standard or conventional elongate, rectangular crib frame structure including a pair of similar, longitudinally spaced, flat, vertical and transversely extending end boards 10, a pair of elongate laterally spaced, longitudinally extending rails 11 (one is shown) extending between and fixed to the end boards 10 at opposite sides of the frame; elongate, flat vertical fences or gates 12 at opposite sides of the frame, outward of the rails 11, and between the end boards; vertical guide rods 13 fixed to and carried by the end boards and slidably supporting the gates 12, to allow for vertical shifting thereof; and latch means 14 to releasably retain the gates in desired vertical position on the rods and relative to the end boards.

The end boards 10 of the crib frame C are fabricated wood units with flat central panels 15 and vertical frame members 16 at their opposite vertical side edges. The vertical frame members have lower end portions which depend from lower ends of the panels 15 to define or establish floor engaging legs 17.

From the foregoing, it will be apparent that the crib frame C has four legs 17, one at each of its corners.

In practice, the lower ends of the legs 17 have downwardly opening central vertical openings 18 to cooperatively receive the vertical mounting pins or pintles of common furniture caster wheels (not shown), which wheels are commonly provided on crib frames to facilitate rolling and moving the cribs across the floors on which they are supported.

In some crib frame structures, the rails 11 are utilized to support standard crib spring frames and/or mattress units. In other standard frames, spaced spring frame and/or mattress unit hangers are screw-fastened to the end boards.

In carrying out the present invention, conventional spring frame and/or mattress structures are not employed. Accordingly, the crib frame rails 11 are not utilized to support such mattress structures and in those cases where mattress hanger brackets are provided, such brackets can be removed and disposed of, if necessary or desired.

It will be apparent that the crib frame C illustrated and described above is a semi-rigid, rectangular framework which is open at its top and bottom to freely receive a mattress structure.

The crib frame C illustrated in FIG. 1 of the drawings, and briefly described above, is a typical, standard crib frame structure of the type and/or class which is well known to all of those skilled in the art to which the present invention relates. In carrying out the present invention, the design and structural features of the crib frame C can be varied considerably without departing from or affecting the present invention.

Figure 2:
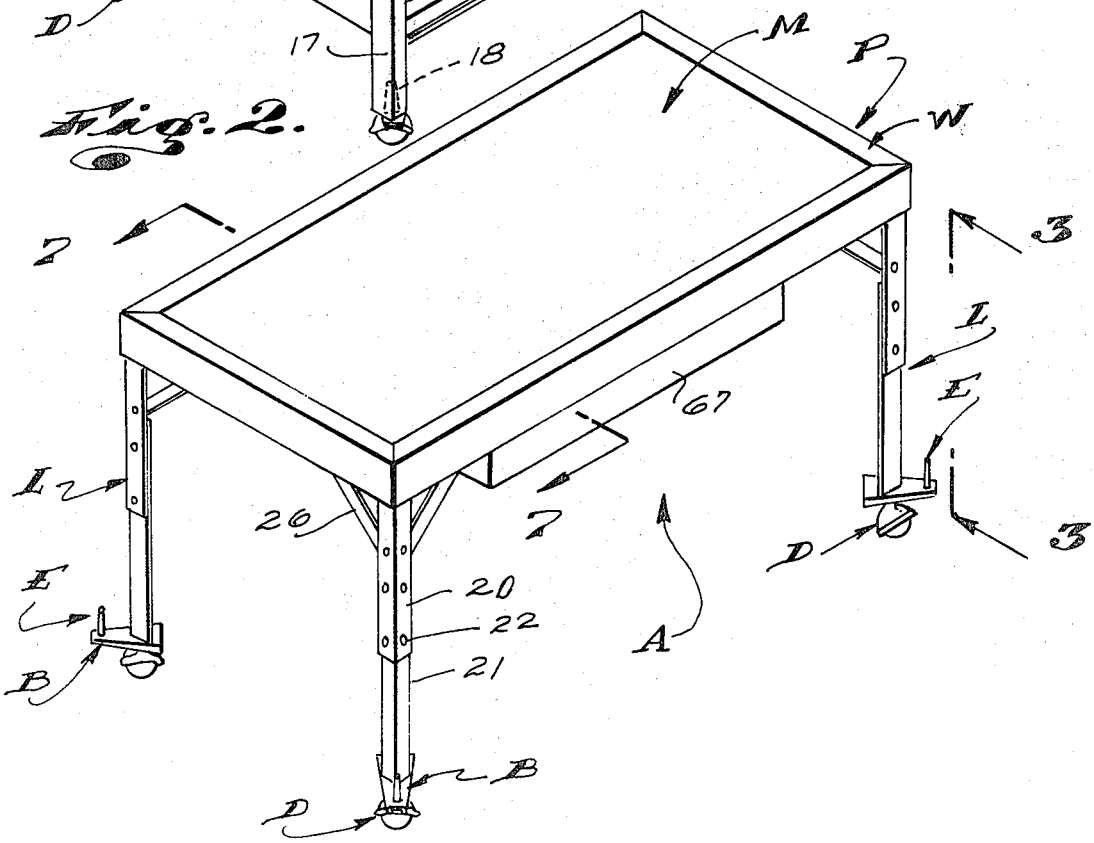
FIG. 2 is an isometric view of the water bed structure separate from the crib frame.

The new crib water bed structure A shown related to the crib frame C in FIG. 1 of the drawings and shown separate in FIG. 2 of the drawings includes a flat, rectangular, horizontal water mattress supporting platform P, a water mattress M carried by the platform P, vertical corner legs L for the platform, crib leg supporting means or brackets B on the legs and caster wheels D at the lower ends of the legs L.

In the basic water bed structure A set forth above, the platform P substantially corresponds in plan configuration with the interior plan configuration of the crib frame C and is freely arranged within the frame in predetermined vertical spaced relationship above the floor on which the construction is supported and between the upper and lower limits of the frame C, as clearly shown in FIG. 1 of the drawings.

The legs L of the bed structure A occur (diagonally) inward of the legs 17 of the crib frame C, in close parallel relationship therewith, and are supported on the floor over which the bed is arranged by the wheels D at the lower ends thereof. The bracket B on the legs L project (diagonally) outward from the legs L to occur below the lower ends of the crib frame legs 17 related thereto and are provided with vertical upwardly projecting pintles E which enter the openings 18 in the lower ends of the legs 17 to releasably retain the legs in stationary supported engagement on the brackets and relative to the legs L.

The mattress M is a substantially flat, horizontal rectangular water filled flexible plastic bladder supported on and overlying the top of the platform P. In practice, if desired, a sheet-like liner of flexible plastic film (not shown) can be arranged between the mattress M and the platform P. Further, in one desired form of mattress and as shown in the drawings, a core or pad of soft resilient reticulated or interconnected cellular foam plastic M' is arranged in the mattress structure to overly the bottom thereof and which has a top surface normally spaced from the top of the mattress. The top of the pad M' normally occurs in close proximity to the plane to which the top of the mattress M is depressed by a body in buoyed engagement atop the mattress.

With the pad M', the overall vertical extent of the mattress can be maintained at a minimum, and the volume of free water is reduced so that surging of water in the mattress is maintained at a low level.

The structure illustrated in FIGS. 1 and 2 of the drawings and described above is the whole of the broader aspects of the present invention.

With the invention thus far described, it will be apparent that the water bed structure A and crib frame C are cooperatively related with each other to provide a water bed crib. It will be further apparent that the bed structure A is such that it can be made to cooperate with substantially any one of the many different makes and models of standard crib frames.

It should be noted at this time that while there is a standard size of crib frame structure, there is also a dimensionally smaller or sub-standard size of crib frame structure which is produced in sufficient quantity to qualify as and be referred to as a standard size crib. In carrying out the present invention, a water bed structure A for use in combination with the noted smaller size crib frames or any other special or non-standard size of crib frame can be provided, without departing from the spirit of this invention.

Figures 3, 4, 5, 6:
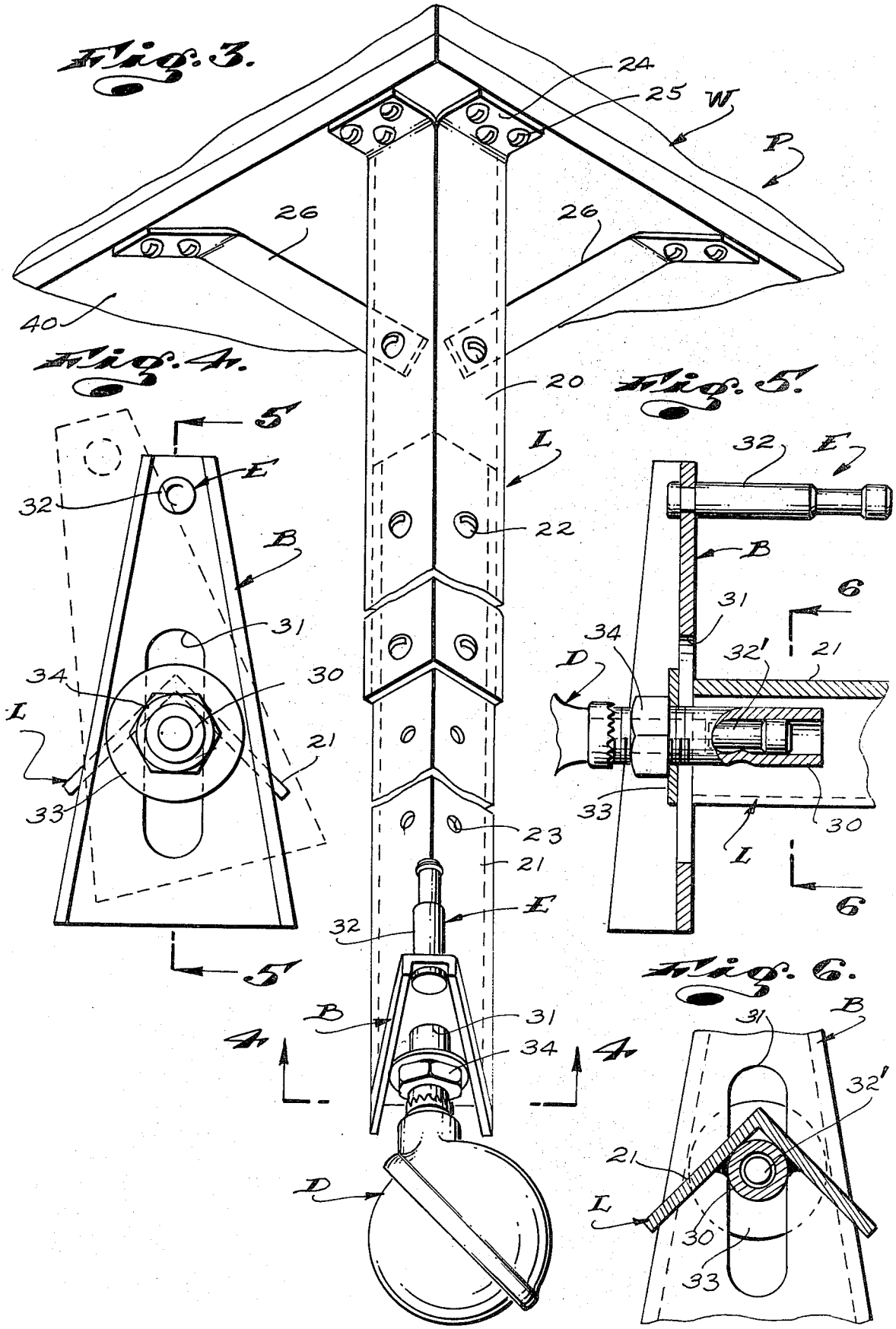
FIG. 3 is an isometric view of one leg of the water bed structure, taken substantially as indicated by line 3—3 on FIG. 2.
FIG. 4 is an enlarged detailed sectional view taken substantially as indicated by line 4—4 on FIG. 3.
FIG. 5 is a cross-sectional view taken substantially as indicated by line 5—5 on FIG. 4.
FIG. 6 is a sectional view taken substantially as indicated by line 6—6 on FIG. 5.

In practice, and as shown in FIG. 3 of the drawings, the legs L of the bed structure A include upper and lower end sections 20 and 21 releasably secured together by fasteners 22 and are such that the length of the legs L can be easily and conveniently adjusted to vary the vertical positioning of the platform P.

In the case illustrated, the sections 20 and 21 of the legs L are angle sections with adjacent lapping end portions in nested or seated engagement with each other. The flanges of the angle sections are provided with a plurality of vertically spaced registerable openings 23 through which the fasteners 22 are engaged.

As shown in FIG. 3 of the drawings, the upper ends of the flanges of the upper leg sections 20 are bent outward to provide mounting pads 24 which engage and are fixed to the bottom surface of the platform P by screw fasteners 25.

The leg sections 20 can be reinforced by gusset bars 26, as shown in the drawings.

The lower ends of the lower leg sections 21 are provided with tubular caster pintle receiving and bracket retaining tube parts 30 arranged in the inside corners of those sections and fixed thereto as by welding. The tube parts 30 have externally threaded lower end portions which project a short or limited distance below the lower ends of the leg sections 21.

The crib leg supporting brackets B are elongate, flat, horizontal plate or pad-like parts with flat top and bottom surfaces and have inner and outer end portions. The inner end portions of the brackets are provided with elongate longitudinally extending vertical through openings or slots 31 to slidably receive the lower end portion of the tube parts 30 related thereto. The outer end portions of the brackets carry vertical crib leg engaging pintles 32 which pintles project upwardly therefrom. The pintles 32 are similar to standard caster wheel pintles and have their lower ends fixed to the brackets as by welding, peening or the like.

In practice, the plan configuration of the brackets B can be varied and the brackets can be formed with reinforcing flanges or the like to impart them with desired structural characteristics.

The brackets B are arranged below the lower ends of their related legs L with their top surfaces in supported bearing engagement with the lower ends of the legs and with the tube parts 30 on the legs extending through and downwardly from the slots 30. The outer end portions of the brackets project outwardly from the legs L with the pintles 32 thereon in parallel spaced relationship with the legs, as clearly illustrated in FIGS. 2 through 6 of the drawings.

The brackets B are releasably held in tight clamped relationship with the lower ends of their related legs L by washers 33 and nuts 34 engaged on and with the lower end of the tube parts 30 and the lower surfaces of the brackets, as clearly shown in FIGS. 3 through 6 of the drawings. The nuts 34 serve to hold the brackets in tight clamped engagement with and between the lower ends of the legs L and the washers 33.

It will be apparent that upon loosening the nuts 34, the brackets can be pivoted about and shifted or slipped axially relative to the legs L and the tube parts 30 to adjust and change the relative positioning of the outer end portions of the brackets and the pintles 32. Such adjusting of the brackets enables the bed structure A to be easily and conveniently set to cooperatively receive and support substantially all standard crib frame structures.

The caster wheels D are standard wheel caster structures having vertical, upwardly projecting mounting pintles 32'. The wheels D are arranged below the legs L with their vertical axes aligned with the tube parts 30 and with their pintles 32' moved axially upwardly into stopped engagement in and with the tube parts, as clearly shown in FIGS. 3 through 6 of the drawings.

Since the make, model and details of construction of the wheels D can vary widely in construction and since the construction, application and use of caster wheels is well known to all of those who are skilled in the art to which this invention relates, further detailed description of the wheels D can and will be dispensed with.

The platform P of the bed structure A is a flat horizontal rectangular unit including a panel 40 established of, for example, plywood or chipboard. The panel 40 has flat horizontal top and bottom surfaces 41 and 42 and flat straight, vertical side and end edges 43.

The leg structures or assemblies of the bed structure A are arranged beneath the four corner portions of the panel 40 and each is fastened thereto as clearly shown in FIG. 3 of the drawings.

The platform P next includes a weir W projecting upwardly from the top surface 41 of the panel 40 about the perimeter thereof. The top surface 41 of the panel is adapted to engage and support the water mattress M. The weir W occurs about the exterior of and is adapted to retain and support the sides of the mattress M.

In the preferred carrying out of the invention, the weir W includes an inner rigid wall structure 50 and a soft, resilient shock absorbing protective jacket 52 about the exterior of the wall structure 50. The wall structure 50 is preferably a thin walled sheet metal or plastic structure and the jacket 50 is a thick layer of skin of a suitable resilient cellular or foam plastic resin. The jacket 52 can be cut from a thick sheet of desired foam plastic and is engaged about and cemented to the exterior surfaces and edges of the wall 50.

In furtherance of the invention and as shown in FIG. 7 of the drawings, the weir W of the platform P is formed to define a central water or liquid conducting passage 60, coextensive with the weir, about the perimeter of the platform. The weir is further provided with the plurality of drain ports 61 which establish communication between the passage 60 and the space inward of the weir and about the panel 40. Additionally, the platform P is provided with drain means 65 to drain liquid or water out of the passage 60, for collection and/or disposal.

In the form of the invention illustrated, the wall 50 of the weir W is a hollow sheet metal wall structure having flat vertical, laterally spaced inside and outside walls 53 and 54 and a horizontal top wall 55. The inside and outside walls 53 and 54 have mounting flanges 56 at their lower edges, which flanges engage and are riveted, screw fastened or otherwise fixed to the panel 40. In the case illustrated, the flange 56 on the outside wall 54 is extended and formed to extend about the outer edge of the panel 40.

To simplify manufacture, the wall structure 50 is established of inside and outside sections with top flanges that are arranged in lapped engagement with each other and fastened to establish the top wall 55. The ports 61 are in the inside wall 53 of the wall 50 and in the portion of the jacket 52, adjacent the inside wall 53, in predetermined spaced relationship below the top wall 55.

The drain means 65 includes a vertical drain opening 66 in the panel 40 communicating with the passage 60, a catch basin 67 mounted below the platform P and a drain tube or conduit 68 extending between the opening and the basin.

The basin 67 is shown as a simple plastic or metal tub having an outwardly projecting rolled or otherwise formed rim. The basin 67 is supported by a pair of spaced hanger brackets 79 fixed to the underside of the panel 40 to occur at opposite side edges of the basin 67 and having flanges which can slidably engage beneath and support the rim of the tub.

The tube 68 is a length of flexible rubber or plastic tubing with one end portion engaged in the opening 66 and with its other end portion extending into an opening at the tub or basin.

In practice, the drain means 65 can vary widely in details and in construction without departing from or affecting the broader aspects of the invention. The means 65 illustrated and described above was selected to show one simple and basic form of drain means that can be advantageously employed.

The mattress M, as noted above, is a water filled flexible plastic bag or bladder supported on the top surface 41 of the platform panel 40 and which is contained about its sides by the weir W. It has a top surface which can be on or near the same plane but is preferably on a plane spaced slightly below the top of the weir. The mattress M is sufficiently deep or of sufficient vertical extent and the core or pad M′ thereof is of sufficient thickness so that when a child is laid atop the mattress and moves thereon, sufficient flotation is afforded by the mattress to minimize the likelihood of the child displacing so much of the water as to cause its body to bottom out, that is, to move downwardly into engagement with the pad M′ and the pad M′ eliminates the likelihood that the child's body will bottom out in stopped relationship on the panel 40 of the platform P.

The platform structure is such that if a mattress should rupture, tear or leak, the water spilled or leaked therefrom will flow and rapidly drain out through the ports 61, passage 60 and thence through the drain means 65. Such draining and disposal of spilled water is highly important since if free water was not drained away or removed from atop the platform, within the confines of the weir W, a child lying on the mattress and within the confines of the weir could drown in the water. The ports 61 are positioned on a horizontal plane below the top plane of the core or pad M′ in the mattress so that free water within the weir drains to a level below the top of the pad and to a level below the level of the body of a child left supported by the pad M′. Further, since the ports are below the top of the pad M′, the possibility of pooling of free water above the plane of the pad on which a child is supported is unlikely.

Effective collecting of spilled water by the drain means 65 is highly important since it prevents water leaked or spilled from the mattress M from freely escaping from the construction and causing water damage in the facilities in which the bed structure is used.

Finally, the bed structure A includes heating means H to heat and to maintain the mattress M at a predetermined desired temperature.

The heating means H, shown in FIG. 7 of the drawings, includes a flat, blanket-type resistance heater unit arranged in flat engagement between the top surface 41 of the platform 40 and the bottom of the mattress M. The heater H can be the same as that heater which is disclosed and claimed in U.S. Pat. No. 4,139,763 for *BLANKET HEATER WITH TEMPERATURE CONTROL MEANS,* issued Feb. 13, 1979. The power supply cord for the heater H is engaged through a power cord opening in the panel 40 of the platform and extends to a suitable power supply (not shown). The power cord opening can be adequately and/or effectively sealed by the application of a piece of duct tape or the like over the opening and the portion of the heater cord leading to and through the opening.

In FIG. 9 of the drawings, another form of heater H' is shown. The heater H' includes a flat heat conducting metal heating plate 90 set and fixed in an opening 91 in the panel 40' of the platform P'. The heating plate 90 has a resistance heater unit U fixed to its underside. The plate 90 also has a temperature sensing device T secured to its underside by a suitable bracket. The device T is a temperature responsive switching device and is secured or connected in and with the power supply for the unit U, substantially as shown in the drawings. A suitable housing 95 is provided at the underside of the platform P' to house and protect the heater H' and to reduce heat loss below the platform which might otherwise adversely affect operation of the heater H'.

In practice, and in accordance with certain special full size water bed structures, the pad M' shown in the drawings can be separate from the mattress M and arranged to occur below and to support the mattress within the confines of the weir. In such a modified embodiment of the invention, the flat blanket type heater which is shown arranged between the bottom of the mattress and the platform can be arranged atop the pad to occur between the pad and mattress in direct heat conducting contact with the mattress.

In practice, while rearranging of parts such as noted above, and other apparent changes that might be made, provide some advantages and might create certain disadvantages, they are, as far as the present invention is concerned, matters of choice which do not alter or affect the broader aspects of the invention.

Having described only typical preferred forms and applications, we do not wish to be limited to the specific details herein set forth, but wish to reserve to ourselves any modifications and/or variations that may appear to those skilled in the art and which fall within the scope of the following claims:

Having described our invention, we claim:

1. A water bed crib including a water bed structure comprising an elongate flat, horizontal rectangular platform with an upwardly projecting weir about its perimeter, a water filled flexible bladder mattress in supported engagement atop the platform and contained about its perimeter by said weir, elongate vertical platform legs fixed to and depending from the four corner portions of the platform, crib frame supporting brackets on and projecting outwardly from the platform legs; and a rectangular crib frame comprising longitudinally spaced, transversely extending vertical end boards, laterally spaced longitudinally extending vertical side gates extending between and connected with related sides of the end boards and elongate vertical crib legs at and depending from the four corners of the frame, said crib frame is positioned substantially freely about the water bed structure with said crib frame legs in supported engagement on said brackets.

2. The water bed crib set forth in claim 1 wherein said brackets are elongate, substantially horizontal parts with inner and outer end portions, means connecting said inner end portions with their related platform legs for pivotal and longitudinal movement of the brackets relative to those legs to position their outer end portions below the crib frame legs and retaining means on said outer end portions engaging the crib frame legs and holding the crib frame legs and brackets against relative horizontal movement.

3. The water bed crib set forth in claim 1 wherein said platform legs include upper sections fixed to the platform and lower sections shiftable axially relative to the upper sections and connecting means releasably securing said sections in desired axial position relative to each other, said brackets are connected with said lower sections whereby the vertical extent of the platform legs are set to position the platform in desired vertical position within the crib frame.

4. The water bed crib set forth in claim 2 wherein said platform legs include upper sections fixed to the platform and lower sections shiftable axially relative to the upper sections and connecting means releasably securing said sections in desired axial position relative to each other, said brackets are connected with said lower sections whereby the vertical extent of the platform legs are set to position the platform in desired vertical position within the crib frame.

5. The water bed crib set forth in claim 2 wherein said retaining means includes elongate vertical pintles on and projecting upwardly from the outer end portions of the brackets and vertical openings entering the lower ends of the crib frame legs and into which the pintles project.

6. The water bed crib set forth in claim 4 wherein said retaining means includes elongate vertical pintles on and projecting upwardly from the outer end portions of the brackets and vertical openings entering the lower ends of the crib frame legs and into which the pintles project.

7. The water bed crib set forth in claim 1 wherein said weir has a central liquid conducting passage and a plurality of fluid ports establishing communication between said passage and the space defined by the weir in which said mattress is positioned whereby water in said space at the exterior of the mattress flows through the ports into said passage; and drain means to drain water from said passage and including a vertical opening in the platform communicating with the passage and an elongate water conduit with one end engaged in the vertical opening and its other end communicating with a water receiving means below the plane of the platform.

8. The water bed crib set forth in claim 7 wherein said mattress has a resilient core in its lower portion and normally in spaced relationship from the top of the mattress, said fluid ports are on a horizontal plane below the top of the core.

9. The water bed crib set forth in claim 7 wherein the platform includes a flat horizontal panel and the weir includes a rigid passage defining wall structure fixed to and projecting upwardly from the perimeter of the panel and a jacket of soft resilient material fixed on the exterior surface of the wall structure.

10. The water bed crib set forth in claim 1 which further includes electric heater means arranged central of and carried by the platform in heating conducting relationship with the mattress.

11. The water bed crib set forth in claim 4 which further includes electric heater means arranged central of and carried by the platform in heat conducting relationship with the mattress.

12. The water bed crib set forth in claim 6 which further includes electric heater means arranged central of and carried by the platform in heating conducting relationship with the mattress.

* * * * *